US011545120B2

(12) United States Patent
Baird et al.

(10) Patent No.: US 11,545,120 B2
(45) Date of Patent: Jan. 3, 2023

(54) ELECTRIC STRINGED MUSICAL INSTRUMENT

(71) Applicant: STRUMCASTER, LLC, Dunedin, FL (US)

(72) Inventors: Kevin Michael Baird, Dunedin, FL (US); Phillip Brian Taylor, Key West, FL (US)

(73) Assignee: STRUMCASTER, LLC, Dunedin, FL (US)

( * ) Notice: Subject to any disclaimer, the term of this patent is extended or adjusted under 35 U.S.C. 154(b) by 131 days.

(21) Appl. No.: 17/212,105

(22) Filed: Mar. 25, 2021

(65) Prior Publication Data

US 2022/0310039 A1 Sep. 29, 2022

(51) Int. Cl.
*G10D 3/06* (2020.01)
*G10D 1/08* (2006.01)

(52) U.S. Cl.
CPC ..... *G10D 1/085* (2013.01); *G10D 3/06* (2013.01)

(58) Field of Classification Search
CPC ..... G10D 1/085; G10D 3/06; G10D 3/00
See application file for complete search history.

(56) References Cited

FOREIGN PATENT DOCUMENTS

JP 2020166266 A * 10/2020 ..... G10H 3/18

OTHER PUBLICATIONS https://thewoodrow.com/, accessed Mar. 23, 2021.
https://strumstick.com/, accessed Mar. 23, 2021.
https://everythingdulcimer.com/, accessed Mar. 23, 2021.
https://www.cbgitty.com/, accessed Mar. 23, 2021.
https://cedarcreekdulcimers.com/, accessed Mar. 23, 2021.

* cited by examiner

*Primary Examiner* — Kimberly R Lockett
(74) *Attorney, Agent, or Firm* — Andrus Intellectual Property Law, LLP

(57) ABSTRACT

An electric stringed musical instrument having a body with a top surface and at least one interior surface, at least two pickup up pockets and at least one control pocket, the pockets connected through a series of channels. A neck is connected to the body and to a headstock. A bridge is connected to the body, at least two pickups are located in the pickup pockets, and at least one control is located in the control pocket. The pickups and controls may be flush mounted with captured screws secured to the interior surface of the body. The neck has may have a width less than 35 mm and includes a fretboard with at least ten spaced frets arranged in a diatonic scale. The neck may include a longitudinal recess for receiving a carbon fiber member permitting the neck to flex perpendicularly to the path of the strings.

20 Claims, 7 Drawing Sheets

ELECTRIC STRINGED MUSICAL INSTRUMENT

FIELD

The embodiments herein are generally related to musical instruments. The embodiments herein are particularly related to electric stringed musical instruments.

BACKGROUND

This Background is intended to introduce various aspects of the art, which may be associated with the present disclosure to thereby assist in providing a framework to facilitate a better understanding of particular aspects of the present disclosure. Accordingly, this Background does not necessarily constitute admissions of prior art.

A STRUMSTICK® is typically a three or four-stringed musical instrument designed for beginners that uses a diatonic scale. In music theory, a diatonic scale is any heptatonic scale that includes five whole steps (whole tones) and two half steps (semitones) in each octave, in which the two half steps are separated from each other by either two or three whole steps, depending on their position in the scale. Related to the strum stick is the mountain or Appalachian dulcimer which is a fretted string instrument of the zither family, typically with three or four strings. The body extends the length of the fingerboard, and its fretting is also generally diatonic. Both instruments consist essentially of a series, or plurality of series, of tuned, taut strings arranged across a sounding board and supported on it by bridges and a wooden or metal body.

A Cigar box guitar is a simple chordophone that uses an empty cigar box as a resonator. The earliest had one or two strings; modern models typically have three or more. Generally, the strings are connected to the end of a broomstick or a 1×3 inch wood slate and to the cigar box resonator.

Electric guitars as known in the state of the art predominantly operate to provide one of two characteristic tonal sounds which are determined by the selected arrangement of pickups on the main body of the guitar positioned beneath the strings. Electric guitars typically have controls and an amplifier or speaker jack for direct connection to an electric sound amplifier and speaker apparatus. Typically, electric guitar controls and pickups are mounted in one of three ways: through cavities routed in the back of the body which then require panels to cover the cavities; in cavities on the front of the body while attached to a control plate or pickguard; or via a mounting plate which is then hidden with the use of a pickup ring.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

Applicants have developed a new electric stringed musical instrument that combines elements of strum sticks, mountain dulcimers, cigar box guitars and electric guitars into an instrument for easy learning. Particularly, the amplification of sounds through electric pickups and an electric sound amplifier and speaker apparatus helps a user understand the basic concepts of strumming and fretting. Generally, the electric stringed musical instrument of the present application includes a reduced size body relative to a standard electric guitar, but larger than a strum stick, mountain dulcimer or cigar box guitar; a reduced width neck relative to a standard electric guitar; a fret board; a series of bridges/saddles; strings; tuners and electronics including potentiometers for volume and tone control, x-way switches and electronic pickups, and a jack to provide amplification when connected to an electric sound amplifier and speaker apparatus.

Accordingly, the electric stringed musical instrument of the present application includes, in one embodiment, a body having at least two pickup up pockets each for receiving a pickup, and at least one control pocket for receiving at least one control. The body also includes an outlet aperture for receiving an output jack. The at least two pickup up pockets, the at least one control pocket and the outlet aperture are connected through a series of channels. The body has a top surface and at least one interior surface, the at least one interior surface accessible though one of the at least one control pocket or the at least two pickup pockets.

The electric stringed musical instrument of the present application also includes a neck connected to the body at a first end and connected to a headstock at a second end. A bridge is connected to the body, at least two pickups located in the pickup pockets, and at least one control located in the at least one control pocket. A series of strings extend from the headstock to the bridge along the neck and extending over the at least two pickups. The neck may have a width less than 35 mm, and in certain embodiments the neck has a width between 25 mm and 35 mm. The neck includes a fretboard with at least ten spaced frets arranged in a diatonic scale. In certain embodiments, the fretboard may include thirteen spaced frets arranged in a diatonic scale. The fretboard may also include also a zero fret at the distal end of the neck. The neck may include a longitudinal recess for receiving at least one carbon fiber member. In certain embodiments, the insertion of the carbon fiber member prevents the neck from bowing due to pressure exerted by the strings under tension. In certain embodiments, two recesses and two carbon fiber members (one on each side of the center of the neck) may be incorporated to further strengthen against bowing if a user wishes to string the instrument with heavier gauge strings.

At least one control may be secured in the at least one control pocket with a shaft rotatably held in a securing structure and at least one captured screw that engages the securing structure and the body such that the at least one control is flush mounted with the top surface of the body. Similarly, the at least two pickups are secured in the at least two pickup pockets with or without a securing structure and at least one captured screw that engages the pickups and the body such that the at least two pickups may be moveably mounted relative to the top surface of the body. The captured screw and securing structure secures the pickup and controls to the body and also allows for the pickups to be raised or lowered. Raising or lowering pickups may change the sound produced.

The bridge may include a plurality of bridge saddles and a plurality of string trees or eyelets such that a first terminal end each string of the series of strings is secured to one string tree or eyelet of the plurality of string trees or eyelets, and a second terminal end of each string of the series of strings is secured to one of a plurality of tuning knobs rotatably connected to the headstock. In certain embodiments, the first terminal end of the string may be secured by passing it through a hole in a backside of the bridge and then through the string tree or eyelet to keep the string lower in relation to the top of the saddle providing better downward pressure. Each of the bridge saddles may include at least one groove for engaging a string of the series of strings. In these embodiments, each string of the plurality of strings engages at least one of the plurality of bridge saddles to create a downward pressure on the saddles. In certain embodiments, the series of strings may be a series of four strings and the plurality of string trees may be three or four string trees. In these embodiments, the plurality of bridge saddles may be three bridge saddles, and include two grooves for engaging two strings of the series of strings.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DESCRIPTION

Figure 1:
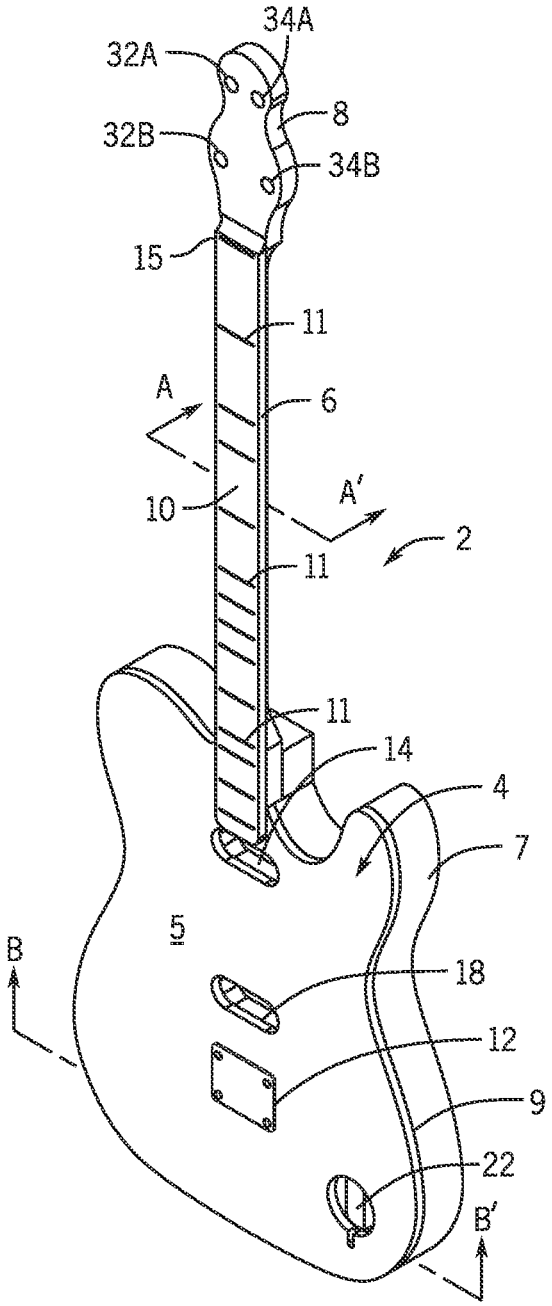
FIG. 1 is a perspective view of the electric stringed musical instrument of the present application.
Figure 6:
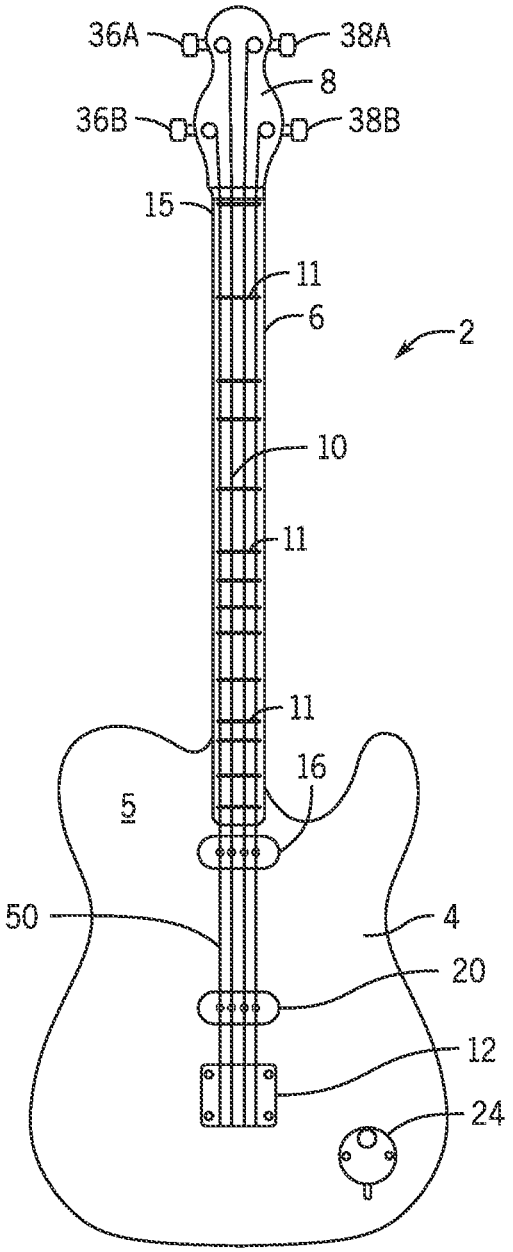
FIG. 6 is a front view of the electric stringed musical instrument of the present application with strings, pickups and control attached.

FIG. 1 depicts a schematic view of an example of the electric stringed musical instrument 2 of the present application. The electric stringed musical instrument 2 includes a body 4, a neck 6, and a headstock 8 located at the distal end of the neck 6. In certain embodiments, the headstock 8 is an integral part of the neck 6; in other embodiments, the headstock 8 is attached though known means to the neck 6. The neck 6 includes a fretboard 10 with a series of frets 11. The body includes a bridge 12, a neck pickup pocket 14 for receiving a neck pickup 16, a bridge pickup pocket 18 (FIG. 6) for receiving a bridge pickup 20 (FIG. 6), and a control pocket 22 for receiving controls 24 (FIG. 6). The body 6 further includes an aperture 60 (FIG. 9) for receiving a traditional output jack for connecting to an electric sound amplifier and speaker apparatus.

Figure 8:
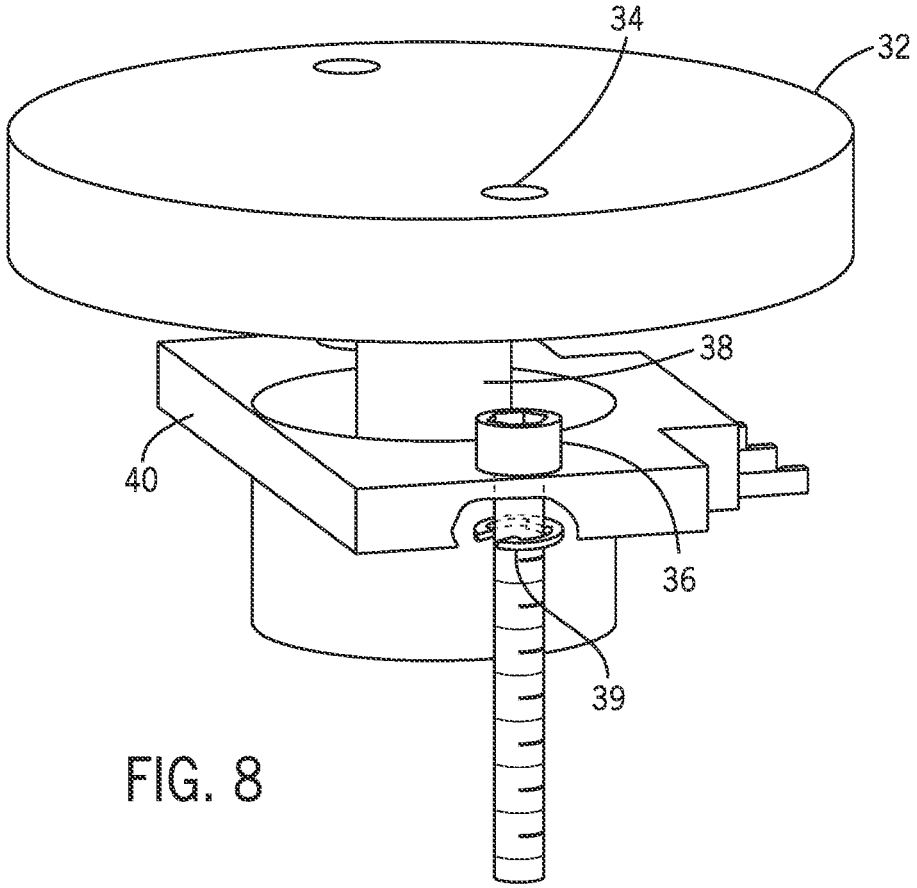
FIG. 8 is a perspective view of a captive screw structure for securing a control.
Figure 9:
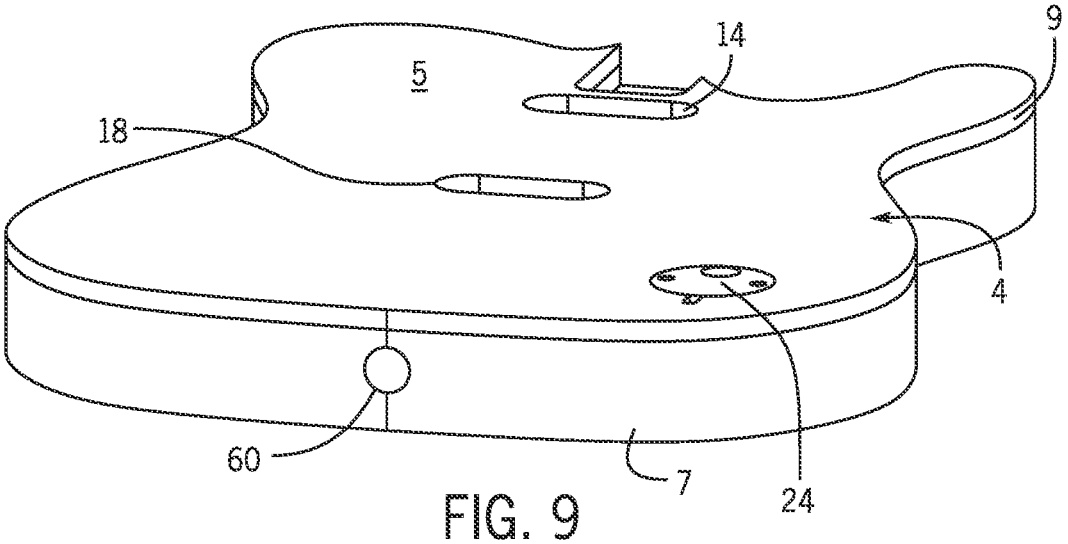
FIG. 9 is a bottom perspective view of a body of the electric stringed musical instrument of the present application.

Referring now to FIGS. 1, 2, 6 and 12, the body 4 is a generally solid structure of wood or other material and has a top surface 5 and interior surfaces 21*a*, 21*b*, and 21*c*. In certain embodiments, the body 4 is a solid body formed of a bottom portion 7 and a top portion 9 glued together. The top portion 9 includes top surface 5. The bottom portion 7 includes interior surfaces 21*a*, 21*b*, and 21*c* and through channels 70*a*, 70*b*, and 70*c* as further described herein. The top portion 9 may be constructed of the same material as the bottom portion 7, or for custom models a different material such as an exotic wood such as spalted maple. Alternatively, the body 4 may be a unitary body constructed from a single piece of material. In this embodiment, wiring runs through a single channel drilled from jack access point 60. As previously discussed, the body 4 includes neck pickup pocket 14, bridge pickup pocket 18, and control pocket 22 each extending through the top portion 7 and into the bottom portion 9. The neck pickup pocket provides access to interior surface 21*a*; the bridge pickup pocket provides access to interior surface 21*b*; and the control pocket provides access to interior surface 21*c*. The body 4 is designed in such a way that the controls 24 and pickups 16, 20 (FIG. 6) can be installed or mounted from the front surface 5 of the body 4. This permits the controls 24 and pickups 16, 20 to be directly mounted to the body 4 with a captured screw 36 integrated into the pickups 16, 20 and control 24 structures. Referring now to FIGS. 8 and 9, therein is shown an exemplary arrangement for the captured screw design for the control 24 received in the body 4. The control 24 may be disc shaped and includes at least one aperture 34 for accessing at least one captured screw 36. The control 24 is attached to a shaft 38 that rotatably held in a securing structure 40. At least one captured screw 36 engages the securing structure 40 and further engages the interior surface 21*c* of the body 4 such that the control 24 is flush mounted with a top surface 5 of the body 4. A clip 39 secures each screw 36 to the securing structure 40. Multiple captured screws 36 may be used to engage the securing structure 40 and the interior surface 21*c* of the body 4. In certain embodiments a threaded insert may be located in the interior surface 21*c* of the body 4 to engage the captured screw(s) 36. The pickups 16, 20 may be secured in a similar manner, however, since the pickups 16, 20 are stationary, the shaft 38 may be excluded altogether and the pickups 16, 20 may be secured in place using at least one captured screw 36. Further, in certain embodiments, the securing structure 40 may be eliminated when mounting the pickups 16, 20 such that the pickups are secured to the body 4 with at least one captured screw 36. The pickups 16, 20 are moveably mounted such that the pickups 16, 20 may be raised or lowered relative to the top surface 5. Multiple control units 24 may be incorporated a further described herein. More than the two pickups 16, 20 may also be incorporated in the design. Mounting the control(s) 24 and pickups 16, 20 in this manner eliminates the need for mounting to a pickguard/control plate or the use of a pickup ring. Also, rear access cavities and cover panels are eliminated allowing for a solid back which is aesthetically more pleasing and also retains more mass in the solid body. This is also an improvement over the front-of-body methods as it reduces the size of the pockets 14 ,18, 22 and eliminates the need for the pickguard/control plates that distract from the natural beauty of the guitar. Further, reducing the amount of material removed for control 24 and pickups 16, 20 increases the sustain of the body 4.

Figure 2:
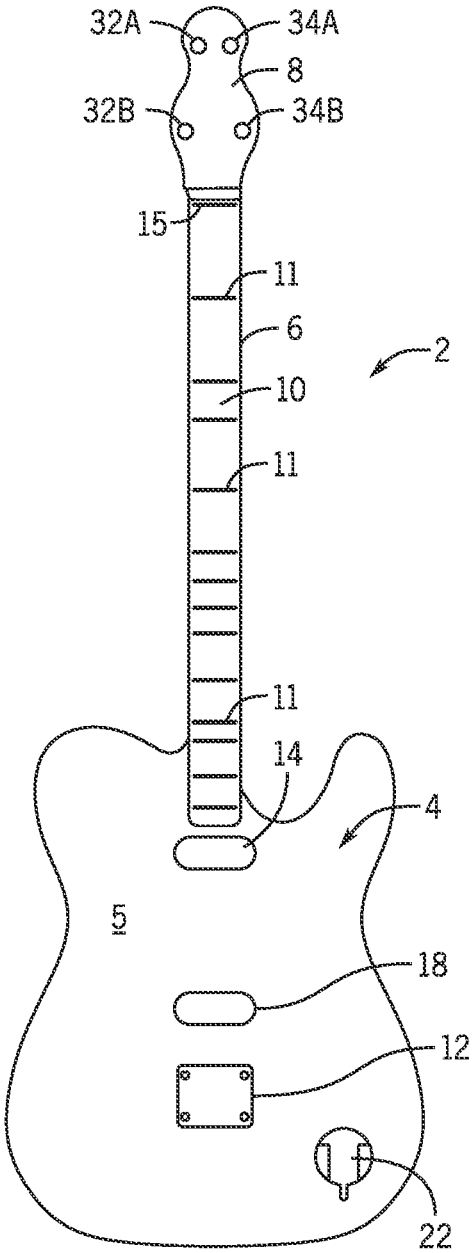
FIG. 2 is a front view of the electric stringed musical instrument of the present application.
Figure 3:
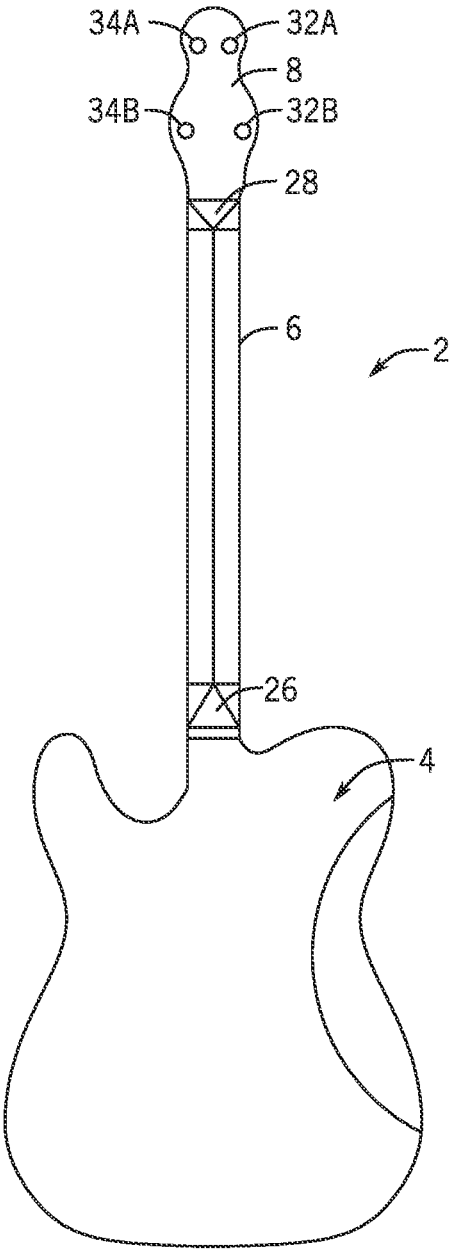
FIG. 3 is rear view of the electric stringed musical instrument of the present application.
Figure 4:
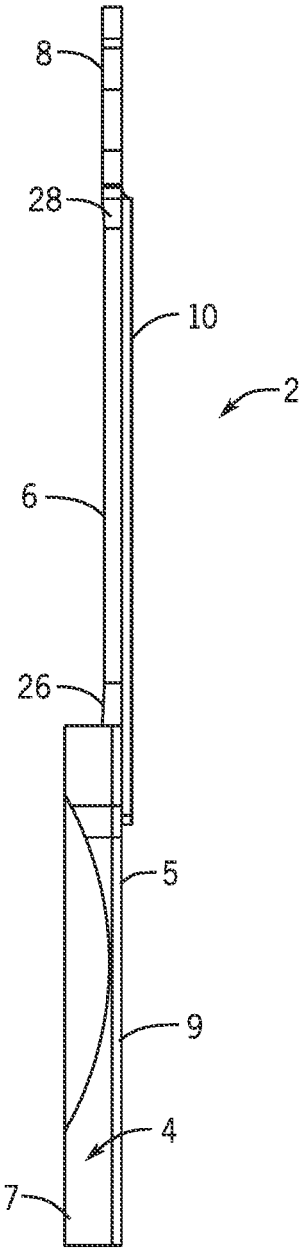
FIG. 4 is a left side view of the electric stringed musical instrument of the present application.
Figure 5:
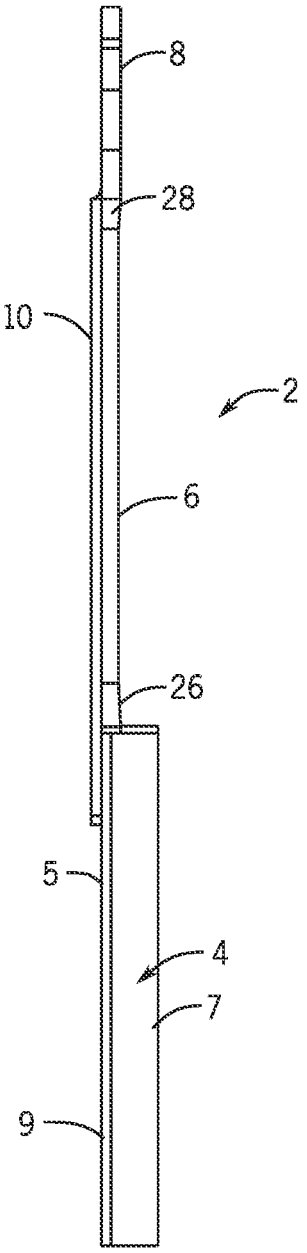
FIG. 5 is a right side view of the electric stringed musical instrument of the present application.

Referring now to FIGS. 3, 4 and 5, the neck 6 is connected to the body 4 at a neck joint 26. In one embodiment, the neck 6 is connected to the body 4 at the neck joint 26 with a bolt on design consisting of four screws and a backing plate. The headstock 8 is integral with or connected to the neck 6 at a headstock joint 28. As shown in FIGS. 1, 2 and 3, the headstock 8 is designed with a 2×2 configuration, with two left hand apertures 32A and 32B for receiving two left hand tuning knobs 36A and 36B (FIG. 6) and two right hand apertures 34A and 34B for receiving two right hand tuning knobs 38A and 38B (FIG. 6). The knobs 36A, 36B, 38A and 38B are all rotatably secured to the headstock and connected to a second terminal ends of strings 50 (FIG. 6). First terminal ends of the strings 50 are connected to the bridge 12 as further described herein.

Referring now to FIGS. 1, 4, 5 and 7, the neck 6 receives the fretboard 10. The fretboard 10 has at least ten frets 11 placed in such a way to create a diatonic scale. In certain embodiments, the fretboard 10 has thirteen frets placed in such a way to create a diatonic scale. The addition of the sixth fret of the thirteen frets 11 allows a user to play what is commonly referred to as the "blues note," i.e. the flatted seventh note of the scale. This permits a user to not only add a blues-style note to songs, and it permits the user play in two different keys on the same instrument. The fretboard 10 also implements a zero fret 15 at the distal end of the neck 6 instead of a traditional nut made of bone, synthetic bone or various other materials. The zero fret 15 has a height slightly taller than the thirteen frets 11, providing the proper height of strings 50 (FIG. 6) above the frets 11.

Figure 7A:
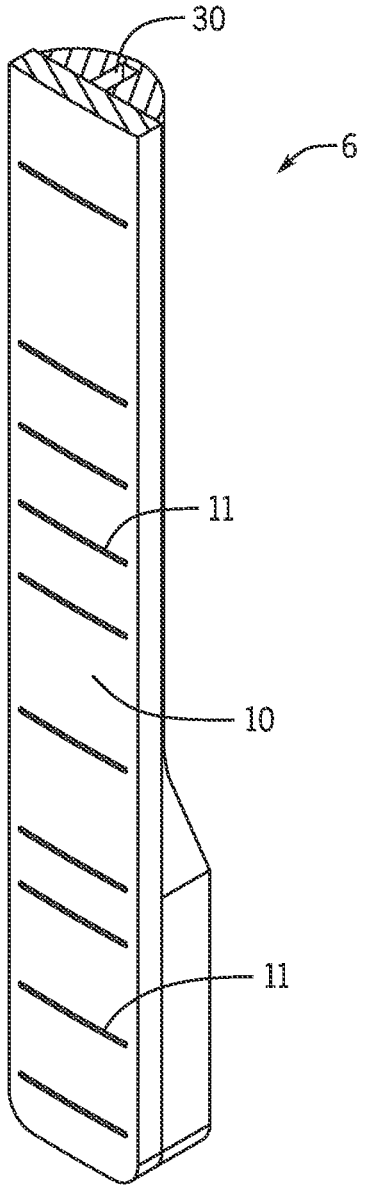
FIG. 7*a* is a cross section of the neck of the electric stringed musical instrument of the present application taken along line A-A' of FIG. 1.
Figure 7B:
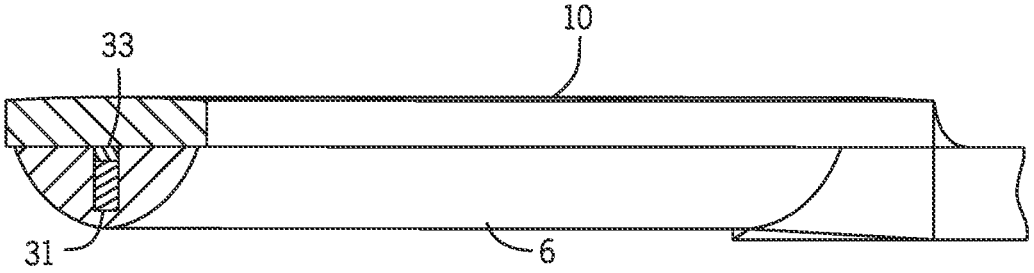
FIG. 7*b* is a perspective view of the cross section of FIG. 7*a*.

The neck 6 is designed to be narrower and thinner than a traditional guitar neck. In one embodiment, the neck width is less than 35 mm. In other embodiments the neck width is between 25 mm and 35 mm. FIG. 7*a* is a cross section of the neck 6 taken along line A-A' of FIG. 1 and demonstrates a longitudinal recess 30 in the neck 6. As shown in FIG. 7*b*, in certain embodiments, the neck 6 may be reinforced with at least one carbon fiber member 31 such as rod or beam located in the recess 30 of the neck 6 to prevent bowing of neck due to string pressure, yet still allow the neck to flex perpendicular to the path of the strings. A filler strip 33 of wood, polymeric material or other flexible material may be incorporated to secure the carbon fiber member 31 in the recess 30. In certain embodiments, two recesses 30 and two carbon fiber members 31—one on each side of the center of the neck 6—may be incorporated to further strengthen against bowing if a user wishes to string the instrument with heavier gauge strings 50 but still permit flexibility. The flexibility of the neck 6 allows the user to create a vibrato which is a change in pitch caused by the strings being made slightly tighter or looser. On a typical electric guitar this effect is created through the use of a whammy bar or tremolo or by bending the strings with a finger. With the electric stringed musical instrument 2 of the present application, all that is necessary to create vibrato is to shake the instrument.

Referring now to FIG. 6, therein is shown the electric stringed musical instrument 2 with strings 50 attached. The strings 50 are secured at first end to the headstock 8 at the two left hand tuning knobs 36A and 36B and two right hand tuning knobs 38A and 38B. The strings 50 extend along the fretboard 10 and are secured at a second end to the bridge 12. The instrument 2 includes four strings, which may include a bass string, a middle string and a double course—two strings close together which are fretted together when playing. The middle and double course may provide the melody when playing. The strings 50 extend over the neck pickup 16 and the bridge pickup 20. The neck pickup 16 and the bridge pickup 20 are traditional magnetic pickups that generate a small electric current when a string moves over the pickup 16, 20. The pickups 16, 20 may be single coil, or humbucker style. The cross section of FIG. 12 demonstrates the interconnection between the neck pickup pocket 14, bridge pickup pocket 18, control pocket 22, and aperture 60 for receiving a traditional output jack in the bottom portion 7 through channels 70*a*, 70*b*, and 70*c*, wherein circuits and wiring (not shown) may be placed to interconnect the control(s) 24, pickups 16, 20 and a traditional output jack. The pickups 16, 20 generate a signal that passes through circuits (not shown) controlled by the control knob 24 to the output jack, and subsequently through a cable to an amplifier and speaker apparatus, as is known in the art, to generate sound. The current induced by the movement of the strings over the pickups 16, 20 is proportional to factors as string density and the amount of movement over the pickups 16, 20.

The controls 24 can be configured with any combination of volume/tone control discs and x-way switches. One or more control discs 24 may be used and secured to the body 4 as described above. The shaft 38 may be connected to volume or tone circuits to control the output of the instrument. Accordingly, by rotating the control 24, the volume or tone of the instrument may be varied. In certain embodiments separate volume and tone controls 24 are used and are recessed to be flush with the top surface of the guitar body 4. The mounting method described above allows for this to happen. This approach provides a significant advantage in that the control knobs are no longer able to interfere with the players strumming where inadvertent contact with the controls can lead to unintended changes in volume or tone.

Figure 10:
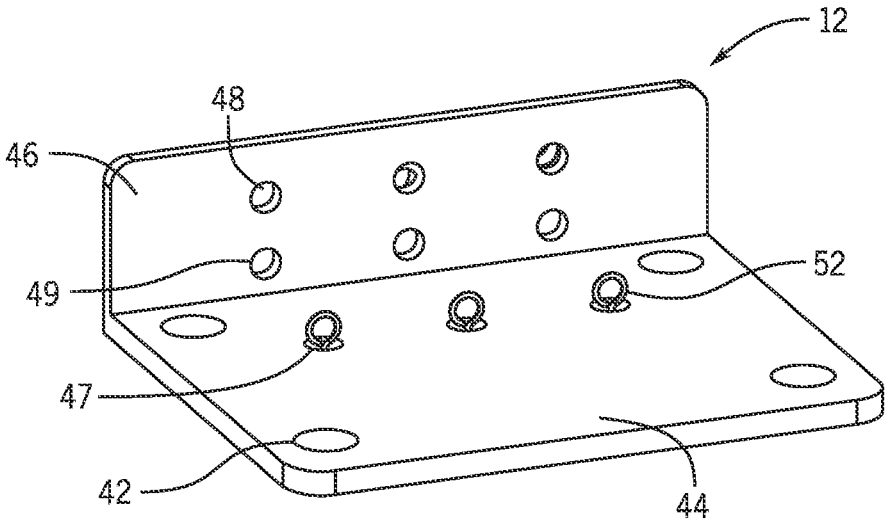
FIG. 10 is a perspective view of a bridge structure for use with the electric stringed musical instrument of the present application.
Figure 11:
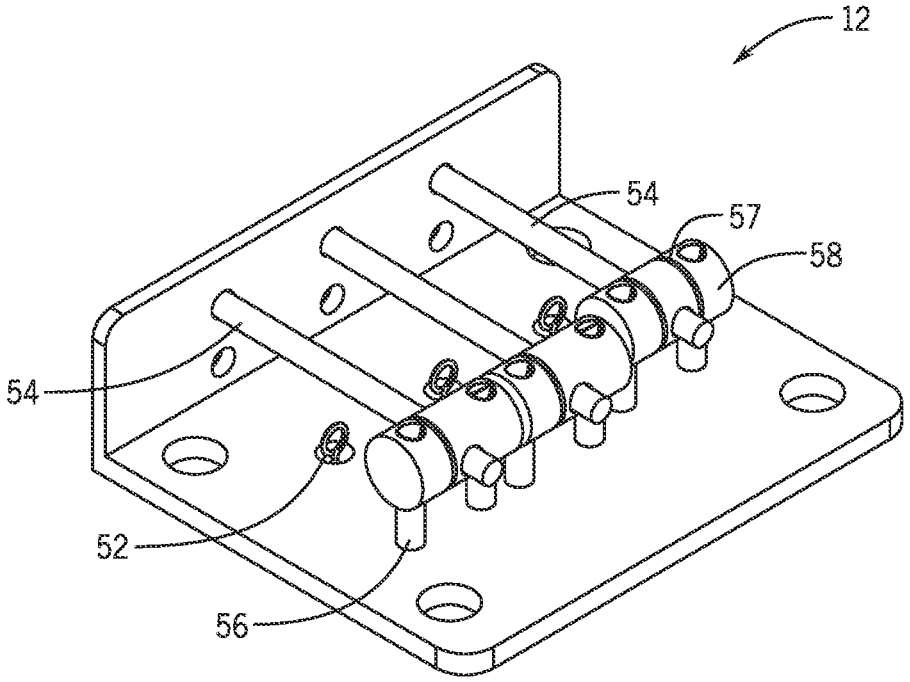
FIG. 11 is the bridge structure of FIG. 10 with a saddle structure attached.
Figure 12:
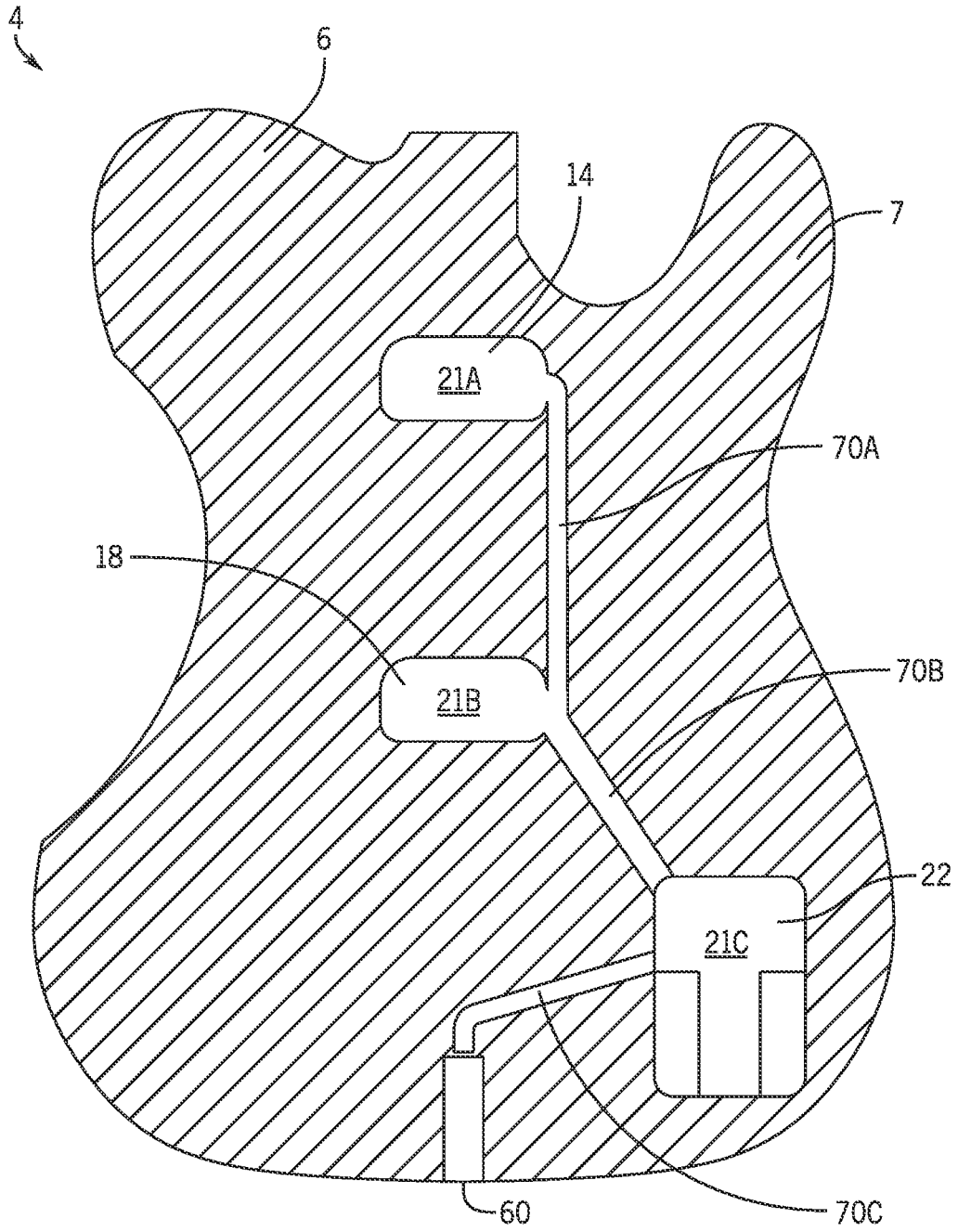
FIG. 12 is a cross section of the body of the electric stringed musical instrument of the present application taken along line B-B' of FIG. 1.

FIGS. 10 and 11 provide additional detail on the bridge 12. The bridge 12 includes a first plate 44 having a plurality of apertures 42 for securing the bridge 12 to the body 4. A second plate 46 is perpendicularly secured to the first plate 44 and also includes a plurality of apertures 48 for receiving longitudinal saddle support screws 54. A second set of apertures 49 are present in second plate 46 for receiving stings 50. String tree structures or eyelets 52 are located in a third set of apertures 47 for securing the second end of the strings 50. As shown in FIG. 11, bridge saddles 58 are mounted to the bridge 12 with longitudinal saddle support screws 54 and transverse saddle support screws 56. The bridge saddles 58 may be cylindrical in shape and may include one or more grooves 57 for engaging a sting 50. In certain embodiments, a bridge saddle may include two grooves 57 for securing the double course strings. In certain embodiments, the first terminal end of a string 50 may be secured by passing it through an aperture 49 in a backside of the bridge and then through the string tree or eyelet 52 to keep the string 50 lower in relation to the top of the saddle 58. As such, the strings 50 pass over the bridge saddles 58 and are secured to the string trees or eyelets 52. The string trees or eyelets 52 create better downward pressure at the bridge saddles 58 permitting the bridge saddles 58 to sit properly and to eliminate string buzz. Accordingly, the strings 50 are installed through the bridge 12 and not through the body 4. Stringing through the body 4 makes string changes more difficult and requires disrupting the back of the body and again removing more of the solid wood body. Adding the string trees 52 eliminates the need to string through the body. In certain embodiments matching string trees 52 may be used on the headstock 8 between the zero fret 15 and the tuning knobs 36B and 38B to provide proper downward pressure over the zero fret 15.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

Any functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electric stringed musical instrument comprising:

a body having a bottom portion and a top portion, the body having at least two pickup up pockets extending through the top portion and into the bottom portion each for receiving a pickup, at least one control pocket extending through the top portion and into the bottom portion for receiving at least one control, and an outlet aperture for receiving an output jack in the bottom portion, the at least two pickup up pockets, the at least one control pocket and the outlet aperture being connected through a series of channels extending through the bottom portion;

a neck connected to the body at a first end and connected to a headstock at a second end;

a bridge connected to the body;

at least two pickups located in the pickup pockets;

at least one control located in the at least one control pocket; and a series of stings extending from the headstock to the bridge along the neck and extending over the at least two pickups.

2. The electric stringed musical instrument of claim 1, wherein the neck includes a fretboard with at least ten spaced frets arranged in a diatonic scale.

3. The electric stringed musical instrument of claim 2, wherein the neck includes a fretboard with thirteen spaced frets arranged in a diatonic scale.

4. The electric stringed musical instrument of claim 2, wherein the fretboard includes also a zero fret at the distal end of the neck.

5. The electric stringed musical instrument of claim 1, wherein the body has a top surface and at least one interior surface, the at least one interior surface accessible though one of the at least one control pocket or the at least two pickup pockets.

6. The electric stringed musical instrument of claim 5, wherein the at least one control is secured in the at least one control pocket with a shaft rotatably held in a securing structure and at least one captured screw that engages the securing structure and the body such that the at least one control is flush mounted with the top surface of the body.

7. The electric stringed musical instrument of claim 5, wherein the at least two pickups are secured in the at least two pickup pockets with at least one captured screw that engages the pickups and the body such that the at least two pickups are movably mounted relative to the top surface of the body.

8. The electric stringed musical instrument of claim 1, wherein the neck includes a longitudinal recess to receive at least one carbon fiber member.

9. The electric stringed musical instrument of claim 1, wherein the neck has a width less than 35 mm.

10. The electric stringed musical instrument of claim 9, wherein the neck has a width between 25 mm and 35 mm.

11. The electric stringed musical instrument of claim 1, wherein the bridge includes a plurality of bridge saddles and a plurality of eyelets such that a first terminal end each string of the series of strings is secured to the bridge, wherein a second terminal end of each string of the series of strings is secured to one of a plurality of tuning knobs rotatably connected to the headstock, and wherein each string of the plurality of strings engages at least one of the plurality of eyelets and bridge saddles to create a downward pressure on series of strings.

12. The electric stringed musical instrument of claim 11 wherein the series of strings comprises four strings and the plurality of string trees comprises three string trees, wherein the plurality of bridge saddles comprises three bridge saddles, and wherein each of the three bridge saddles includes at least one groove for engaging a string of the series of strings.

13. The electric stringed musical instrument of claim 12 wherein one of the plurality of bridge saddles includes two grooves for engaging two strings of the series of strings.

14. An electric stringed musical instrument comprising:

a body having at least two pickup up pockets each for receiving a pickup, at least one control pocket for receiving at least one control, and an outlet aperture for receiving an output jack, the at least two pickup up pockets, the at least one control pocket and the outlet aperture being connected through a series of channels;

a headstock having a plurality of tuning knobs rotatably connected to the headstock;

a neck having a first end and a second end, the neck connected to the body at the first end and connected to the headstock at the second end, the neck including fretboard with at least ten spaced frets arranged in a diatonic scale;

a bridge connected to the body, the bridge including a plurality of bridge saddles and a plurality of string trees or eyelets;

at least two pickups located in the pickup pockets and mounted along an upper surface of the body;

at least one control located in the at least one control pocket and flush mounted along an upper surface of the body; and a series of strings each having a first terminal end and a second terminal end, the first terminal end of each string of the series of strings secured to the bridge and the send terminal end secured to one of the tuning knobs of the plurality of tuning knobs located on the headstock such that the series of strings extend from the headstock to the bridge along the fretboard and extend over the at least two pickups and engage at least one of the plurality of bridge saddles.

15. The electric stringed musical instrument of claim 14 wherein the neck includes a fretboard with thirteen spaced frets arranged in a diatonic scale and a zero fret at the distal end of the neck.

16. The electric stringed musical instrument of claim 14, wherein the neck includes a longitudinal recess receiving a carbon fiber member permitting the neck to flex perpendicularly to the path of the strings, and the neck has a width between 25 mm and 35 mm.

17. The electric stringed musical instrument of claim 14 wherein the series of strings comprises four strings and the plurality of string trees comprises three string trees, wherein the plurality of bridge saddles comprises three bridge saddles, and wherein each of the three bridge saddles includes at least one groove for engaging a string of the series of strings.

18. The electric stringed musical instrument of claim 14 wherein the at least one control is secured in the at least one control pocket with a shaft rotatably held in a securing structure and at least one captured screw that engages the securing structure and the body; and wherein the at least two pickups are secured in the at least two pickup pockets with at least one captured screw that engages the each of the at least two pickups and the body.

19. An electric stringed musical instrument comprising:

a body having at least two pickup up pockets each for receiving a pickup, at least one control pocket for receiving at least one control, and an outlet aperture for receiving an output jack, the at least two pickup up pockets, the at least one control pocket and the outlet aperture being connected through a series of channels;

a headstock having a plurality of tuning knobs rotatably connected to the headstock;

a neck having a first end and a second end and a width between 25 mm and 35 mm, the neck connected to the body at the first end and connected to the headstock at the second end, the neck including fretboard with at least ten spaced frets arranged in a diatonic scale, the neck including a longitudinal recess for receiving a carbon fiber member;

a bridge connected to the body, the bridge including a plurality of string trees or eyelets;

at least two pickups located in the pickup pockets;

at least one control located in the at least one control pocket and flush mounted along an upper surface of the body with a shaft rotatably held in a securing structure and at least one captured screw that engages the securing structure and the body;

a series of stings each having a first terminal end and a second terminal end, the first terminal end of each string of the series of strings secured to one string tree of the plurality of string trees and the send terminal end secured to one of the tuning knobs of the plurality of tuning knobs located on the headstock such that the series of strings extend from the headstock to the bridge along the fretboard and extend over the at least two pickups; and wherein the longitudinal recess in the neck receives a carbon fiber member permitting the neck to flex perpendicularly to the path of the strings.

20. The electric stringed musical instrument of claim 19 wherein the neck includes a fretboard with thirteen spaced frets arranged in a diatonic scale, a zero fret at the distal end of the neck, the series of strings comprises four strings and the plurality of string trees or eyelets comprises four string trees or eyelets, and the at least two pickups are secured in the at least two pickup pockets with at least one captured screw that engages each of the at least two pickups and the body.

* * * * *